US005366690A

United States Patent [19]

Garde

[11] Patent Number: 5,366,690

[45] Date of Patent: Nov. 22, 1994

[54] ZIRCONIUM ALLOY WITH TIN, NITROGEN, AND NIOBIUM ADDITIONS

[75] Inventor: Anand M. Garde, West Simsbury, Conn.

[73] Assignee: Combustion Engineering, Inc., Windsor, Conn.

[21] Appl. No.: 77,936

[22] Filed: Jun. 18, 1993

[51] Int. Cl.[5] ..... C22C 16/00

[52] U.S. Cl. ..... 420/422; 148/672

[58] Field of Search ..... 420/422; 148/672

[56] References Cited

U.S. PATENT DOCUMENTS

| | | | |
|---|---|---|---|
| 4,648,912 | 3/1987 | Sabol et al. | 148/11.5 |
| 4,649,023 | 3/1987 | Sabol et al. | 420/422 |
| 4,664,831 | 5/1987 | Hibst et al. | 252/62 |
| 4,675,153 | 6/1987 | Boyle et al. | 376/416 |
| 4,879,093 | 11/1989 | Garde | 420/422 |
| 4,938,920 | 7/1990 | Garzarolli et al. | 376/457 |
| 4,963,316 | 10/1990 | Stehle et al. | 420/422 |
| 4,963,323 | 10/1990 | Matsuo et al. | 420/422 |
| 4,992,240 | 2/1991 | Komatsu et al. | 420/422 |
| 5,023,048 | 6/1991 | Mardon et al. | 376/416 |
| 5,080,861 | 1/1992 | Garde | 420/422 |
| 5,112,573 | 5/1992 | Foster et al. | 420/422 |
| 5,125,985 | 6/1992 | Foster et al. | 148/672 |
| 5,196,163 | 3/1993 | Matsuo et al. | 420/422 |

FOREIGN PATENT DOCUMENTS

| | | |
|---|---|---|
| 0532830 | 3/1993 | European Pat. Off. . |
| 0538778 | 4/1993 | European Pat. Off. . |

OTHER PUBLICATIONS

The Mettalurgy of Zirconium, Benjamin Lustman and Frank Kerze, Jr. ASM Handbook, vol. 3, Alloy Phase Diagrams.

Development of Highly Corrosion Resistant Zirconium-Base Alloys.

Influence of Chemical Composition on Uniform Corrosion of Zirconium-Base Alloys in Autoclave Tests, Eucken, et al.; Interaction of Oxidation and Creep in Zircaloy-2, Burton, et al.; Microstructure and Mechanical Behavior of Materials, vol. 1, Haicheng, et al.

Notes on the Corrosion Behavior of Zircaloy-2 with various levels of Iron Content, D. B. Scott; The Influence of Tin Content on the Thermal Creep of Zircaloy-4, McInteer, Baty, and Stein.

*Primary Examiner*—Upendra Roy

*Attorney, Agent, or Firm*—Ronald P. Kananen; Mulholland, John H.

[57] ABSTRACT

The alloy of the present invention features controlled amounts of tin, nitrogen, and niobium and includes tin (Sn) in a range of greater than 0 to 1.50 wt. %, wherein 0.6 wt. % is typical. The alloy also has iron (Fe) in a range of greater than 0 to 0.24 wt. %, and typically 0.12 wt. %; chromium (Cr) in a range of greater than 0 to 0.15 wt. % and typically 0.10 wt. %; nitrogen (N) in a range of greater than 0 to 2300 ppm; silicon, in a range of greater than 0 up to 100 ppm, and typically 100 ppm; oxygen (O) in a range of greater than 0 and up to 1600 ppm, and typically 1200 ppm; niobium (Nb) in a range of greater than 0 wt. % to 0.5 wt. % and typically 0.45 wt. %; and the balance zirconium.

15 Claims, 4 Drawing Sheets

ZIRCONIUM ALLOY WITH TIN, NITROGEN, AND NIOBIUM ADDITIONS

BACKGROUND OF THE INVENTION

This invention relates to alloys for use in light water nuclear reactor (LWR) core structural components and fuel cladding. More particularly, this invention relates to a zirconium alloy for such use which exhibits superior corrosion resistance and mechanical properties after irradiation. Still more particularly, this invention relates to a zirconium alloy with improved corrosion resistance and mechanical properties by controlling its alloy composition to within particular ranges. Still more particularly, this invention relates to a zirconium alloy with controlled levels of tin (Sn), nitrogen (N), and niobium (Nb) additions to within specified limits, also suitable for pressurized water reactors (PWRS).

DESCRIPTION OF THE PRIOR ART

Zirconium alloys are used in the fuel assembly structural components of nuclear reactors, such as in fuel rod cladding, guide or thimble tubes, grid strips, instrument tubes, and so forth because of their low neutron cross section, good corrosion resistance against high pressure/high temperature steam and water, good mechanical strength, and fabricability. Zirconium alloys, particularly those commonly known as Zircaloy-2 and Zircaloy-4 have been used in light water reactor cores because of their relatively small capture cross section for thermal neutrons. The addition of 0.5 to 2.0 percent by weight niobium and up to 0.25 percent of a third alloying element to these zirconium alloys for purposes of corrosion resistance in the reactor core is suggested in U.S. Pat. No. 4,649,023 as part of a teaching of producing a microstructure of homogeneously disbursed fine precipitates of less than about 800 angstroms. The third alloying element is a constituent such as iron, chromium, molybdenum, vanadium, copper, nickel and tungsten.

Pellet-clad interaction (PCI) resistance is sought in U.S. Pat. Nos. 4,675,153 and 4,664,831 by use of zirconium-based alloys including "zirconium-2.5 w/o niobium". The latter teaching also refers to "Zr—Nb alloys containing about 1.0 to 3.0 w/o Nb". In these patents, oxygen is present "below about 350 ppm of said alloy".

U.S. Pat. No. 4,648,912 teaches improving high temperature corrosion resistance of an alpha zirconium alloy body by rapidly scanning the surface of the body with a laser beam. The alloy treated included zirconium-niobium alloys. Thus, it has been found by various investigators in the prior art literature that the addition of niobium to a zirconium alloy for use in light water reactors will reduce hydrogen uptake from waterside corrosion, stabilize alloying element-irradiation defect complexes, and make the alloy more resistant to annealing of irradiation damage. It is also reported by investigators that niobium will enhance work hardenability of irradiated Zircaloy but that an addition of niobium above the I percent level will not result in further additional benefit in mechanical properties.

An improved ductile irradiated zirconium alloy is described in U.S. Pat. No. 4,879,093 issued to an inventor in this application. The alloy has a stabilized microstructure which minimizes loss of alloy ductility required to resist release of fission gases and to handle spent fuel safely. The alloy retains a reasonable corrosion resistance in both pressurized water reactors (PWR) and boiling water reactors (BWR) because of its optimum intermetallic precipitate average particle size. The alloy of the U.S. Pat. No. '093 patent is based on an alpha phase zirconium-tin-niobium or alpha phase zirconium-tin-molybdenum alloy having characteristics as shown in Table 1 of that patent with niobium, if present, in a range of from a measurable amount up to 0.6 percent by weight. The molybdenum, if present, is in a range of from a measurable amount up to 0.1 percent by weight. The zirconium-tin system is known as "Zircaloy" and, typically, if Zircaloy-4, for example, would also have 0.18 to 0.24 percent by weight iron, 0.07 to 0.13 percent by weight chromium, oxygen in the range of from 1000 to 1600 ppm, 1.2 to 1.7 percent by weight tin, and the remainder zirconium.

U.S. Pat. No. 4,992,240 discloses another zirconium alloy containing on a weight basis, 0.4 to 1.2% tin, 0.2 to 0.4% iron, 0.1 to 0.6% chromium, not higher than 0.5% of niobium, and balance zirconium, wherein the sum weight proportions of tin, iron and chromium is in the range of 0.9 to 1.5%. Oxygen, according to FIG. 4 of the U.S. Pat. No. '240 patent, is about 1770 ppm to 1840 ppm. Niobium is apparently optional, and silicon is not reported.

Recent trends in the nuclear industry include shifts toward higher coolant temperatures to increase the thermal efficiency and toward higher fuel discharge burnups to increase the fuel utilization. Both the higher coolant temperatures and discharge-burnups tend to increase the in-reactor corrosion and hydrogen uptake of the zirconium alloys. The high levels of neutron fluence and simultaneous hydrogen pickup degrade the ductility of zirconium alloys. For these more demanding service conditions, it is therefore necessary to improve the corrosion resistance and irradiated ductility of zirconium alloys.

Accordingly, it is a continuing problem in this art to develop a zirconium alloy having superior ductility after irradiation; good corrosion resistance, especially independent of processing history; reduced hydrogen uptake; good mechanical characteristics, such as static strength, creep strength, and so forth; and good fabricability.

It is another continuing general problem in this art to improve the corrosion resistance and irradiated ductility of zirconium alloys used in fuel assembly structural components in nuclear reactors.

It is another general aim in this art to provide a zirconium alloy with improved corrosion resistance without compromising mechanical property requirements and fabricability considerations.

These and other aims and objectives of this invention will become apparent from a review of the description of the invention which follows.

SUMMARY OF THE INVENTION

It is an object of this invention, therefore, to provide a zirconium alloy with improved corrosion resistance.

It is an additional object of this invention to provide a zirconium alloy with an improved corrosion resistance and enhanced irradiated ductility while maintaining satisfactory mechanical properties.

It is still another object of this invention to provide a zirconium alloy with improved corrosion resistance and irradiated ductility by an addition of controlled amounts of nitrogen to a zirconium-tin alloy.

It is yet another object of this invention to provide a zirconium alloy with a predetermined alloy composition for improving corrosion resistance and irradiated ductility by lowering the tin content of the zirconium alloy accompanied by an addition of nitrogen and niobium.

The invention is based upon an analysis of both in-PWR and ex-reactor autoclave corrosion data of Zircaloy-4 which indicates that lowering the tin content of the alloy improves its corrosion resistance. This observation is attributed to an increased oxygen diffusion rate through the zirconium oxide layer when tin ions are added to the oxide layer. It is suggested that substitution of $Zr^{4+}$ ions by $Sn^{3+}$ ions in the oxide phase increases the anion vacancy concentration in the oxide, thereby increasing the oxidation rate (1,2). If nitrogen is added to Zr—Sn alloys, the $N^{3-}$ and $Sn^{3+}$ ions form a complex with the anion vacancy thereby reducing the mobility of the anion vacancy. Such reduction in mobility is expected to increase the corrosion resistance of the alloy (1, 2). Although the individual additions of both N and Sn are detrimental to the corrosion resistance of zirconium alloys, a combined addition of both elements would not show the detrimental effect of each element on the corrosion resistance.

The optimization of the alloy composition (within the ranges specified below) can proceed as follows. The tin level is set according to the mechanical property requirements, such as static strength, creep strength, and so forth. The level of nitrogen addition then is determined based on the evaluation of long-term autoclave water corrosion test at 360° C. on the Zr—Sn alloy of selected Sn level with different additions of nitrogen and fabricability considerations. Since the solubility of nitrogen in zirconium alloys is significant (3), for the nitrogen levels suggested below, no new precipitates are expected to form in the alloy. Therefore, an adverse effect of N addition on mechanical properties is not expected. The reasons for the niobium addition is to enhance the irradiated ductility of the alloy and to reduce the hydrogen uptake (4, 5). Iron and silicon are added to improve the corrosion resistance and oxygen is added as a strengthener. Thus, the addition of nitrogen to the Zr—Sn alloy is a main feature of the invention. The reasons for selecting specific levels of the different alloying elements are given below, and the composition of the alloy according to the invention is shown in Table 5.

The alloy of the present invention thus includes tin (Sn) in a range of greater than 0 to about 1.50 wt. %, wherein 0.6 wt. % is typical. The alloy also has iron (Fe) in a range of greater than or equal to 0 to about 0.24 wt. %, and typically 0.12 wt. %; chromium (Cr) in a range of greater than or equal to 0 to about 0.15 wt. % and typically 0.10 wt. %; nitrogen (N) in a range of greater than 0 to 2300 ppm; silicon (Si) in a range of greater than or equal to 0 up to about 100 ppm, and typically about 100 ppm; oxygen (O) in a range of greater than 0 and up to about 1600 ppm, and typically 1200 ppm; niobium (Nb) in a range of greater than 0 wt. % to 0.5 wt. % and typically 0.45 wt. %; and the balance zirconium.

These and other features of the invention will be seen in the disclosure.

DETAILED DESCRIPTION OF THE INVENTION

Zircaloy-4Characteristics

Figure 1:
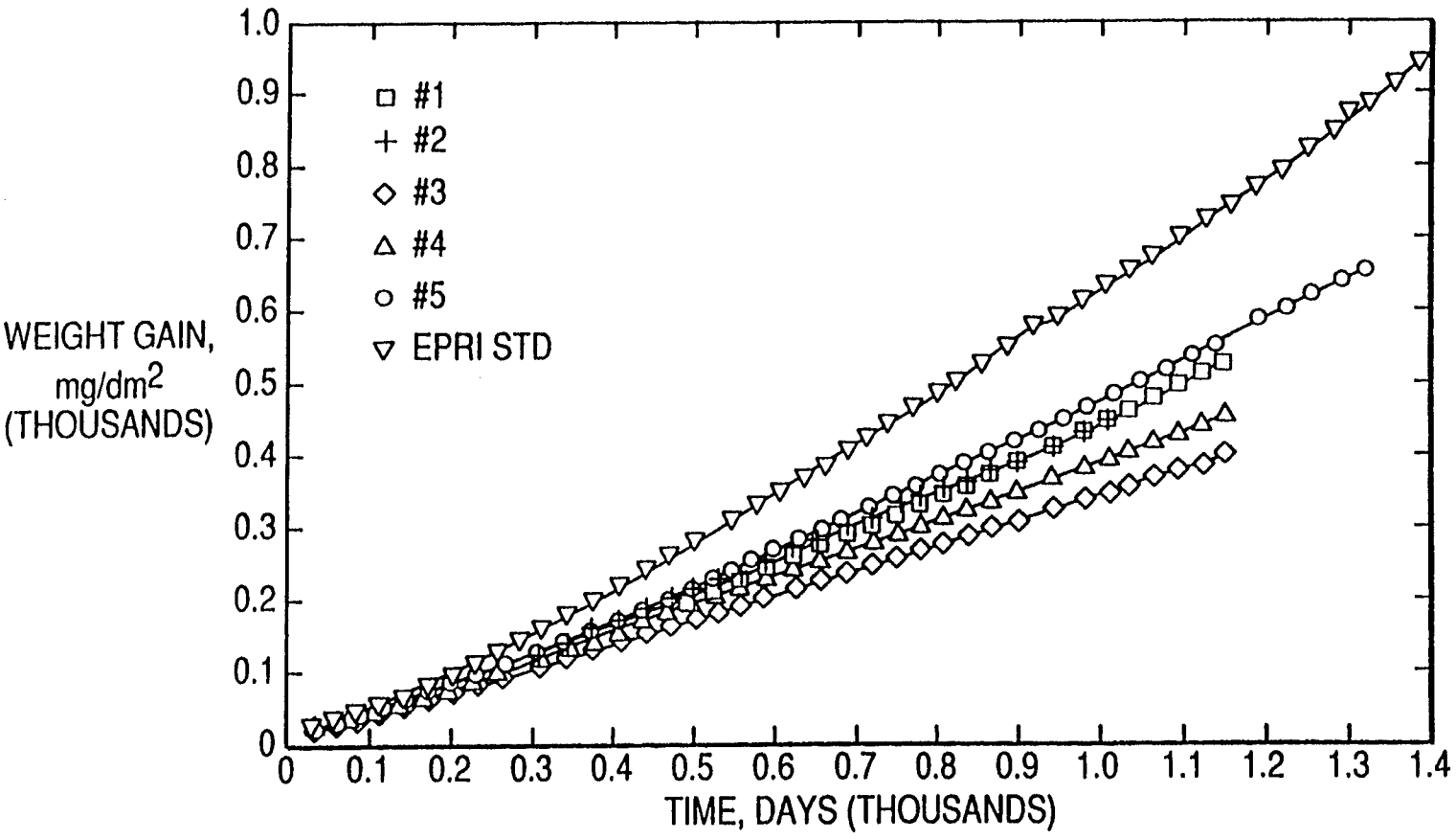
FIG. 1 is a graph of a corrosion weight gain as a function of autoclave test exposure time for several Zircaloy-4 tube variants.

It was previously indicated that a recent analysis of both in-PWR and ex-reactor autoclave corrosion data of Zircaloy-4 indicates that lowering the tin content of the alloy improves its corrosion resistance. Zircaloy-4 with compositional limits as specified for the zirconium-tin alloy grade UNS Number R60804 in the ASTM Standard Specification for Zirconium and Zirconium Alloy Ingots for Nuclear Application (ASTM B350-91) has been traditionally used as the cladding and structural material for pressurized water (PWR) fuel assemblies. To improve uranium utilization and reduce nuclear fuel cycle cost, there has been a continuous demand to increase the discharge burnup of PWR fuel assemblies since the late 1970s. It was recognized fairly early that the corrosion performance of Zircaloy-4 cladding would be a life-limiting phenomenon for higher burnup operation, particularly in reactors with high coolant temperatures. With that realization, investigations were undertaken by various researchers to improve the corrosion performance of fuel rod cladding.

One approach in this regard was to improve the corrosion resistance of Zircaloy-4 by controlling the composition within the ASTM specified range and also optimize the thermomechanical processing for the specific in-reactor environment. In the category of controlling composition within the ASTM B-350 specification limit, studies related to the effect of tin content received the first attention since, from the period of early development of zirconium-based alloys, it has been known that the corrosion resistance of zirconium-tin binary alloys decreased with increasing tin content. However, a minimum level of tin was found to be necessary in Zircaloy-4 to counteract the deleterious effect of nitrogen and other impurities that were normally present in sponge zirconium used in producing Zircaloy-4 ingots of that period. In contrast, the nitrogen content of modern commercial Zircaloy-4 ingots is lower, and as a result, opportunity exists to improve corrosion resistance by reoptimizing the tin content of Zircaloy-4. Several investigators reported autoclave test results on the effect of varying tin content, and the data confirmed the expected trend of lower weight gain with a reduction in tin content. Limited data have also recently become available to confirm that trend in reactors. However, sufficient details of the data, including companion autoclave test results on weight gain and hydrogen uptake, are not available to make a quantitive evaluation of the effect of tin content on the in-reactor corrosion and to provide insight into the mechanism for the effect of tin on the uniform corrosion resistance of Zircaloy-4 in a high-temperature PWR environment.

As will be seen, in-reactor cladding oxide thickness data (as measured on fuel rods from fuel assemblies irradiated in two PWR's, hereinafter referred to as Reactors A and B) are presented for Zircalloy-4 cladding having three ranges of tin content, i.e., (a) from 1.50 to 1.58 wt %; (b) 1.44 to 1.50 wt %; and (c) 1.32 to 1.44 wt %. Otherwise, the cladding tubes were manufactured to the same specification. These tin concentration ranges are referred to respectively as high-tin, intermediate-tin, and low-tin, respectively. While high-tin content represented the industry standard prior to the mid-eighties, the low-tin content is the current industry standard. In addition, a limited number of fuel rods with variations in the cladding fabrication annealing parameter were irradiated in Reactor A. Representative oxide thickness data from measurements of more than 200 fuel rods are reported here. These data cover a fuel rod axial average burnup range of 6 to 49 GWd/MTU and maximum circumferentially averaged oxide thicknesses ranging from 3 to 113 microns (μm). Long-term 633° K. water autoclave corrosion data and post corrosion-test hydrogen concentration measurements are presented. The autoclave data are used to evaluate the relationship between autoclave weight gain and in-PWR oxide thickness and to estimate the effect of tin content on the hydrogen pickup fraction. In-reactor oxide thickness data are analyzed by a fuel rod cladding corrosion model, here referred to as ESCORE and referring to EPRI Steady State Core Reload Evaluator code, accounting for the detailed power history and thermal hydraulic environments. Modifications to the cladding corrosion model are here proposed, as in a paper to be presented by the inventor shortly following this filing, for the observed effect of tin on a Zircaloy-4 cladding corrosion.

The characteristics of the different Zircaloy-4 cladding tube variants that are discussed here and in the inventor's paper are listed in Table 1. The Table also includes the EPRI standard material which was tested in the long-term autoclave test program to facilitate a comparison of corrosion test results from different autoclaves. The tin level varied from 1.33 to 1.55%, and the annealing parameter varied from $1.0\times10^{17}$ to $4.1\times10^{17}$ hours. These values of integrated annealing parameter were calculated using a Q/R value of 40,000° K. The annealing parameter values near the low end of the investigated range represent commercial cladding tubes manufactured in 1986 to 1988. Cladding variants with the high annealing parameters were fabricated to study the effect of annealing parameter variations on the in-PWR corrosion of Zircaloy-4.

The final tube heat treatment (for all the variants listed in Table 1) was stress relief annealing (SRA) resulting in an elongated, partially recrystallized grain structure in the as-received tubing. The inside tube surface was pickled and the outside tube surface was belt-abraded for all the variants.

Experimental Procedure

Autoclave Testing

All of the cladding variants listed in Table 1 were corrosion tested in PWR fuel cladding geometry in two static autoclaves. The corrosion tests were conducted in deionized water at 633° K. according to the procedure described in the paper, "Enhancement of Aqueous Corrosion of Zircaloy-4 Due to Hydride Precipitation at the Metal-Oxide Interface", *Zirconium in the Nuclear Industry: Ninth International Symposium, ASTM STP* 1132, C. M. Eucken and A. M. Garde, Eds., Americal Society for Testing and Materials, Philadelphia, 1991, pp. 566–594. The total autoclave exposure time was up to 1331 days.

A single specimen of each type was subjected to hydrogen analysis after known autoclave test exposure. The selected samples were sectioned into ring segments and were subjected to hydrogen analysis at two different laboratories. Since zirconium calibration standards containing high hydrogen levels (>30 ppm) are not available, the hydrogen concentration was measured on adjacent pieces of the same specimen in two different laboratories to confirm the hydrogen concentration levels. The average value from all the replicate measurements was used to calculate the hydrogen uptake fraction results presented.

The oxide layers on both the inside and outside tube surface were not removed before the hydrogen analysis. The hydrogen content of the cladding was measured at Laboratory A using a LECO Model RHIEN hydrogen analyzer in which a small piece of specimen (about 0.2 g weight) was fused in a graphite crucible by impulse furnace heating. The evolved gases were collected by a flow of pure argon. The hydrogen concentration was deduced from the change in the thermal conductivity of the gas mixture. National Bureau of Standards (NBS) calibration standards with known low hydrogen levels and α-titanium specimens containing higher hydrogen levels were used for the instrument calibration. The same technique for hydrogen measurement was used by Laboratory B, except for the use of a different hydrogen analyzer (Strohlein H-mat 251).

Poolside Oxide Thickness Measurement Technique

A nondestructive eddy current technique was used to measure the zirconium oxide film thickness on irradiated fuel rods. The measurements were performed during refueling outages in the reactor spent fuel pool. The primary components used to perform the measurements are an eddy current probe that contacts the surface of the rod and a Fischerscope® that measures variations in the impedance of the electrical field that is established between the probe and a fuel rod. In addition, the measurement system includes a computerized data acquisition system, and mechanical systems that align the probe in contact with the surface of the rod and translate the rod past the probe. Calibration of the eddy current probe was frequently checked in the pool using autoclaved Zircaloy-4 tube specimens (same geometry as the fuel cladding) having oxide thicknesses encompassing the expected oxide thickness range on the fuel rods. The thickness of oxide on each of the autoclaved specimens was determined out of water using mylor films of known thickness. It was determined that the variation of tin level in the autoclaved standards within the composition range 1.3 to 1.6% Sn did not have a significant effect on the measurements.

Fuel rods were measured by one of two methods, i.e., either the fuel rods were removed from the assembly and then measured, or the rods were measured while residing in the assembly (i.e. peripheral rods). Both methods generate a linear trace at a particular azimuthal orientation of the rod. The position along the rod of each thickness measurement is determined by an axial position transducer, and these data are mated with thickness data in a two dimensional array of oxide thickness and location. For rods measured after removal from the assembly, multiple scans at selected azimuthal orientations (i.e. 0°, 90°, 180°, 270°) result in an axial and circumferential map of oxide thickness for each rod. An axial profile at a single azimuthal orientation is obtained for rods measured in an assembly.

The oxide thickness traces were analyzed to determine the maximum oxide thickness for each rod. This thickness was computed by averaging all thickness measurements 1.25 cm above and below the specific elevation. The maximum oxide thickness observed along the length of a fuel rod is generally taken as a key parameter in determining its operational capability relative to cladding corrosion. Therefore, the maximum oxide thickness data on the measured fuel rods have been used in this study.

Results

The long-term autoclave corrosion weight gain results for the cladding variants are presented in FIG. 1. A comparison of corrosion weight gain results of Variants 1, 2, and 5 show that for high tin Zircaloy-4 (~1.55% Sn), for the investigated range of annealing parameter, there was no significant difference in the 633° K. water autoclave test results. These results are in agreement with the long-term 673° K. steam autoclave test results of Schemel, et al. The EPRI standard exhibited the highest weight gain. Although its tin level corresponds to the other high-tin variants, it was fabricated to a different specification requiring a higher as-fabricated strength level and at an earlier time frame compared to the rest of the variants listed in Table 1. In recent years, the chemical homogeneity, annealing parameter control and uniformity of Zircaloy-4 tube production lots has improved resulting in an improved corrosion resistance of Zircaloy-4. The low-tin Variants 3 and 4 (1.33% Sn) show lower weight gain values than the high-tin variants. The best corrosion resistance (i.e. least weight gain) is exhibited by Variant 3, and the weight gain values are about 20% lower than those for the high-tin variants (1, 2, and 5). In comparison to the EPRI standard, after 1100 days of 633° K. water autoclave exposure, Variant 3 shows a 45% lower weight gain.

The post-autoclave corrosion test cladding hydrogen concentration measurements and the calculated pickup fractions are presented in Table 2. A comparison of pickup fraction values for the high-tin Variants 1, 2, and 5 and the EPRI standard shows that the fabrication history variations associated with the different annealing parameters do not appear to affect the pickup fraction. The hydrogen pickup fraction for high-tin cladding is in the range of about 26 to 30%. The pickup fractions for the low-tin variants 3 and 4 are in the same range, implying that the tin level variation within the investigated range has a negligible effect on the hydrogen pickup fraction. These latter measurements also show that, with respect to the annealing parameter within the investigated range for the low-tin Zircaloy-4, there is no significant effect on the hydrogen pickup fraction.

The hydrogen concentration values for specimens measured at Laboratory B are about 12% lower than the values on adjacent pieces of the same specimens that were measured at Laboratory A. This difference may be attributed to the differences in measuring equipment used between the two laboratories. The relative ranking of hydrogen concentrations among the variants, however, is the same for the measurements done at the two laboratories.

Figure 2:
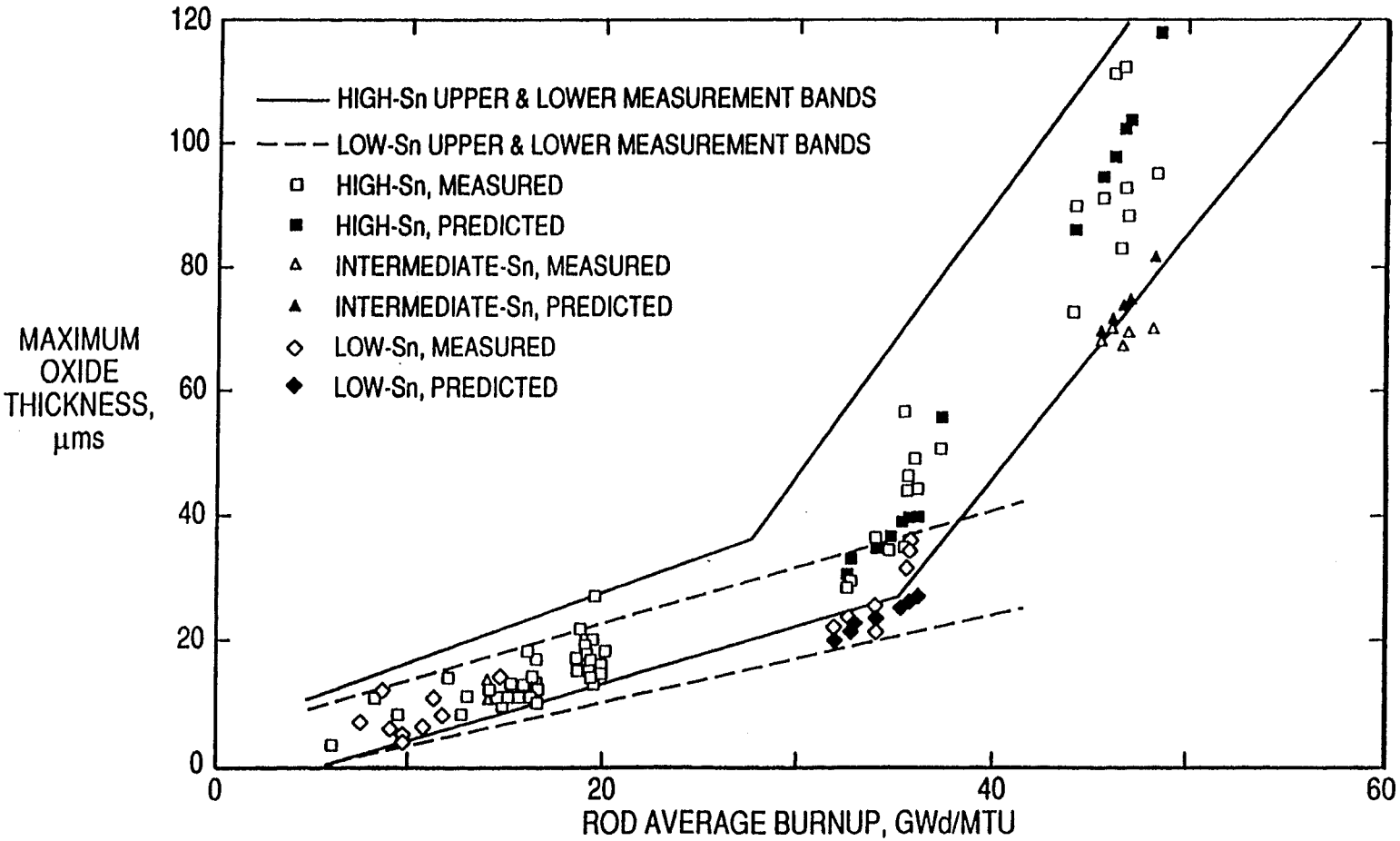
FIG. 2 is a graph of a maximum oxide thickness (measured and predicted) on Zircaloy-4 cladding as a function of rod average burnup for fuel rods irradiated in PWR-A.

The results of the poolside measurements of cladding oxide thickness at Reactor A (on production fuel rods fabricated with cladding with high, intermediate, and low-tin Zircaloy-4) during successive refueling outages are presented in FIG. 2. The cladding tubes included in this figure were fabricated over a range of time period. The high burnup (37 to 48 GWd/MTU) fuel rods used early production batches (EPB) that were fabricated in 1981–1982. At that time chemical homogeneity and annealing parameter uniformity was not as rigorously enforced as in the later years. This contributed to a wide scatter band in oxide thickness values. Cladding for the low burnup (<37 GWd/MTU) fuel rods were fabricated in 1987 with fabrication history similar to Variants 1 and 3 listed in Table 1. Cladding oxide thicknesses were measured on a large number of fuel rods. The upper and lower bounds for the high-tin cladding shown in FIG. 2 represent oxide measurements on 138 fuel rods fabricated with high-tin cladding. Similarly, the scatter band for the low-tin cladding oxide thickness represents measurements on 32 individual rods with low-tin cladding (Variant 3). Individual oxide thickness values shown in FIG. 2 represent specific fuel rods selected (from a much larger database) for corrosion modeling. Details of corrosion modeling including other relevant information regarding Reactor A are discussed later. Although an oxide thickness difference between low-tin and high-tin cladding at rod average burnups less than 20 GWd/MTU is not apparent, at higher burnups there is a consistent trend of lower oxide thickness for low-tin cladding compared to the high-tin cladding. At a burnup of about 35 Gwd/MTU, the average oxide thickness for low-tin cladding is about 40% lower than the average for the high-tin cladding.

Figure 3:
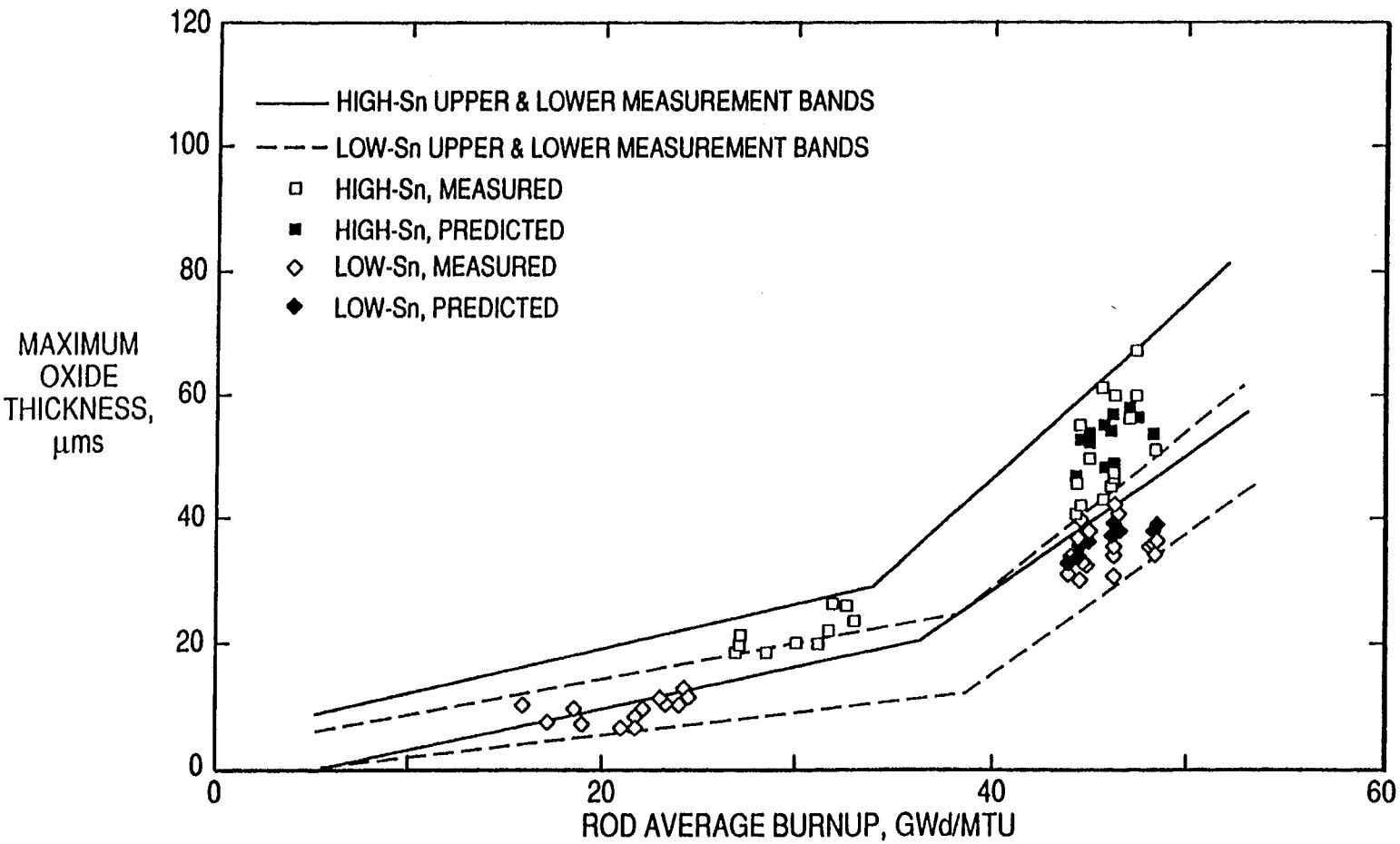
FIG. 3 is a graph of a maximum oxide thickness (measured and predicted) on Zircaloy-4 cladding as a function of rod average burnup for fuel rods irradiated in PWR-B.

Similar measurements for fuel rods fabricated with cladding with high-tin and low-tin Zircaloy-4 and irradiated in Reactor B are shown in FIG. 3. The databands for the high-tin and low-tin cladding rods represent individual measurements on 29 and 35 fuel rods, respectively. At a burnup of about 45 GWd/MTU in Reactor B, low-tin cladding shows about 30% lower oxide thickness than the high-tin cladding.

Figure 4:
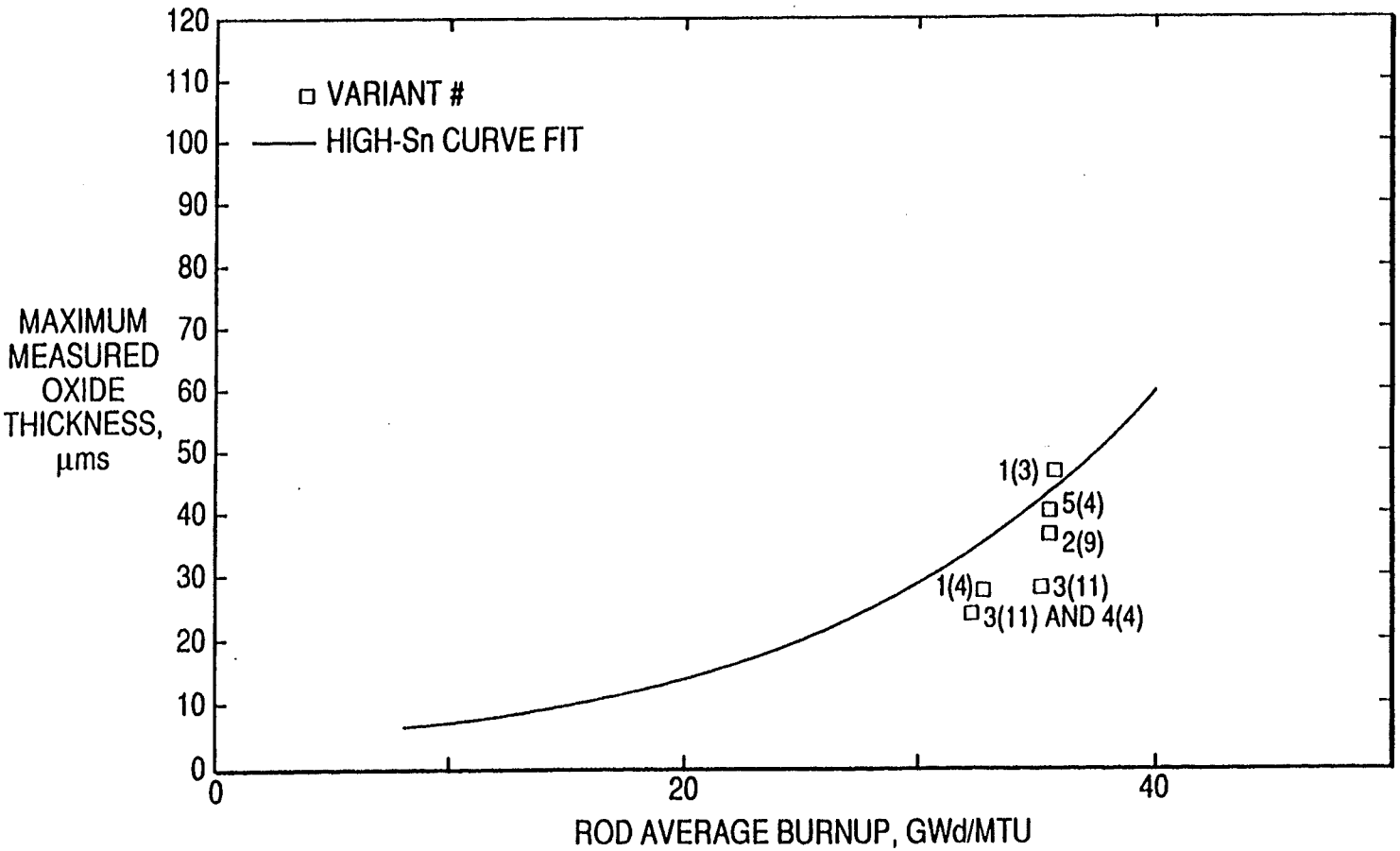
FIG. 4 is a graph of a maximum measured cladding oxide thickness as a function of fuel rod average burnup for Zircaloy-4 variants compared to the High-Sn curve.

The cladding variants listed in Table 1 were irradiated side by side in the same assemblies in Reactor A to minimize the effect on corrosion of differences in power history and thermal-hydraulic environment. The cladding oxide thicknesses measured on these variants are presented in FIG. 4. The best-estimate correlation for oxide thickness versus rod average burnup for the high-tin cladding in Reactor A is presented in FIG. 4 for comparison. The best-estimate correlation was obtained by curve fitting the high-tin data shown in FIG. 2. As expected, the data points associated with the Variants 1, 2, and 5 fall close to the high-tin curve in FIG. 4. The data points for the low-tin variants (3 and 4) fall below the curve, confirming the in-PWR benefit of low-tin material indicated by the 633° K. water autoclave results. At a burnup of about 35 GWd/MTU, the low-tin Zircaloy-4 has oxide thickness values 30 to 40% lower than those for high-tin cladding. Consistent with the 633° K. water autoclave results, no significant effect of the annealing parameter variation (over the range studied) is seen in the in-reactor measurements for either group of cladding.

Effect of Tin-level on the Oxide Thickness

The long-term water autoclave weight gain data and in-PWR oxide thickness measurement data presented demonstrate the improvement in the uniform corrosion resistance of Zircaloy-4 with a decrease in the tin content of the material. The extent of improvement appears to be greater in reactor than what is indicated by the 633° K. water autoclave test results. This may be related to the effect of tin level on the microstructure of irradiated Zircaloy or the hydrogen uptake of the irradiated Zircaloy.

The uniform corrosion of zirconium alloys in high temperature water is postulated to be controlled by oxygen ion migration (via a vacancy exchange mechanism) through the oxide layer from the coolant/oxide interface to the oxide/metal interface. Additions of $Sn^{3+}$ ions (which replace a $Zr^{4+}$ ion) to the oxygen deficient $ZrO_{2-x}$, lattice increase the $O^{2-}$ vacancy concentration in the oxide lattice and, thereby, increase the oxygen diffusion in the oxide lattice. The corrosion rate of the binary alloy is therefore increased. Conversely, a reduction in tin content is expected to reduce the $O^{2-}$ vacancy concentration in the oxide lattice and, thereby, reduce the oxygen transport through the oxide. Thus, the beneficial effect of lower tin level on the corrosion resistance of Zircaloy-4 may be related to lowering of the $O^{2-}$ ion vacancy concentration in the oxide layer.

However, Zircaloy-4 is an alloy more complex than a zirconium-tin binary. A more applicable mechanism may also involve interaction with nitrogen. It has been known for a long time that the effect of tin on the uniform corrosion resistance of Zircaloy-4 is related to the nitrogen level in the Zircaloy-4. Corrosion rate enhancement due to nitrogen is believed to result from the creation of an $O^{2-}$ ion vacancy by the presence of an $N^{3-}$ ion instead of an $O^{2-}$ ion. Although in binary zirconium alloys, additions of tin and of nitrogen individually degrade the corrosion resistance, the additions of both elements together in a ternary zirconium alloy appear to negate the detrimental effect of the other alloying element on the corrosion resistance. This combined effect of Sn—N additions to Zircaloy is postulated to be similar to the observed, combined effect of Sn and Bi additions on the uniform corrosion resistance of Zr—Bi—Sn ternary alloys.

When both $Sn^{3+}$ and $N^{3-}$ ions are present, these ions are expected to form a complex with the oxygen ion vacancy and, thereby, reduce the mobility of the vacancy. Such a reduction in the vacancy mobility decreases the oxygen migration and improves the corrosion resistance of the ternary alloy. The possibility of a $Sn^{3+}-N^{3-}$ oxygen ion vacancy complex formation is consistent with the size of the ions. The ionic radii are: $Zr^{4+}$, 0.79A°; $Sn^{3+}>0.71$°A, $<1.02$°A, and probably about 0.80°A; $N^{3-}$, 1.71°A; and $O^{2-}$, 1.40°A. An association of an oxygen ion vacancy with a $Sn^{3+}$ ion in place of a comparable size $Zr^{4+}$ ion and a neighboring, slightly larger $N^{3-}$ ion at an $O^{2-}$ ion lattice site will reduce the overall volumetric strain associated with individual $O^{2-}$ vacancies and $N^{3-}$ and $Sn^{3+}$ ions.

The observed variability of the effect of Sn on the uniform corrosion resistance of Zircaloy-4 (for example, only 15% improvement in corrosion resistance with respect to normal tin materials reported as opposed to larger improvements observed in this investigation) is likely to be caused, at least partly, by differences in the nitrogen concentration present in these materials. Unfortunately, the nitrogen levels in different Zircaloy-4 materials investigated are rarely reported. The nitrogen concentration for the variants used in the current investigation are listed in Table 1 and are fairly constant at 14 to 27 ppm. It is suggested that an optimization of the tin and nitrogen levels in Zircaloy may be beneficial to improve the uniform corrosion resistance of the Zircaloy. The optimum tin level can be selected on the basis of the strength and creep resistance requirements of the Zircaloy. The nitrogen level then can be adjusted to negate the deleterious effect of the selected tin level on the corrosion properties of the Zircaloy.

Effect of Tin Level On Hydrogen Uptake

Hydrogen uptake data presented in Table 2 indicate that the variation of tin level within the Zircaloy-4 composition range does not alter the hydrogen uptake significantly. The small variation in hydrogen uptake fraction values listed in Table 2 is considered to be within the experimental measurement accuracy. The hydrogen uptake value for autoclaved specimens listed in Table 2 is higher than the upper limit on hydrogen uptake (18%) observed in PWRs. The significantly higher coolant flow velocity in PWRs compared to static autoclaves probably contributes to this difference in the hydrogen uptake fractions.

The hydrogen migration from the water/oxide interface to the metal/oxide interface is probably by the migration of $H^+$ ions (protons). The location within the oxide where $H^+$ reacts with the electron (moving in the opposite direction) influences whether hydrogen will be lost to the coolant flow or gets charged into the metal. The electron migration may occur through the oxide matrix or via the second phase particles, which are better conductors than the oxide matrix for the electron transport. Consider the transport through the oxide first. If the proton combines with an electron (moving in the opposite direction) close to the oxide/water interface, there is a greater chance for the charge neutralized hydrogen atom to be carried away by the coolant, and the hydrogen uptake of the metal would be lower. This is likely to occur if the n-type semiconductor zirconia has excess electrons available due to the replacement of a $Zr^{4+}$ ion by a higher valency ion such as $Nb^{5+}$. This argument suggests that a replacement of a $Zr^{4+}$ ion by a trivalent tin ion would increase the chance of hydrogen migration toward the metal. This argument would suggest a higher hydrogen uptake fraction with increasing tin content. The tin range investigated in the current work is probably not large enough to observe this change in the hydrogen uptake fraction. It is also possible that the tin level may influence the solubility of iron and chromium in Zircaloy-4. The variation of tin level in Zircaloy-4, therefore, may affect the extent of the second phase particle precipitation. A change in the size and volume fraction of second phase particles may change the short circuit transport paths for electrons and, thereby, affect the hydrogen transport. Additional experimental work on irradiated Zircaloy-4 fuel cladding with variations in tin content are needed to resolve the mechanisms of in-PWR hydrogen uptake. The limited available data on irradiated Zircaloy-2 are not directly applicable to the modern Zircaloy-4 used in PWRs due to irradiation under oxygenated coolant conditions and the absence of a beta-quenching step in the old Zircaloy-2 included in the hot-cell examination.

Correlation Between Autoclave Corrosion Results and In-PWR Cladding Oxide Thickness Measurements The autoclave corrosion weight gain data presented in FIG. 1 show the following trend in descending order of weight gain: Variant 5 (highest weight gain), Variants 1 and 2 together, and Variants 4 and 3 (with the lowest weight gain). It is to be noted that the difference in weight gain between the Variant 5, 1 and 2 is small. The in-PWR oxide thickness measurements (FIG. 4) for the same cladding variants rank essentially in the same order as the autoclave measurements. In-PWR measurements seem to segregate into two groups. One group is the high-tin data for Variants 1, 2, and 5, and the other group is the low-tin data of Variants 3 and 4. Small variations within each group are difficult to interpret, but could be associated with minor differences in power history and local thermal hydraulic conditions. This data comparison supports the suggestion that a long-term 633° K. water autoclave corrosion test is a good screening test for ranking the in-PWR corrosion resistance of Zircaloy-4 variants.

Effect of Annealing Parameter

A comparison of Variants 1 and 2 is useful to evaluate the effect of annealing parameter in high-tin Zircaloy-4. The autoclave data in FIG. 1 shows no difference in weight gain for these two variants, while the in-PWR oxide thickness data (FIG. 4) show that a higher annealing parameter may improve the corrosion resistance slightly. A similar comparison for low-tin cladding variants shows that the lower annealing parameter Variant 3 has slightly better corrosion resistance in the autoclave tests, while the in-PWR oxide thickness data (FIG. 4) show no effect of annealing parameter. These comparisons show that any effect of annealing parameter (within the investigated range) on the corrosion rate, if it exists, is minor. Relative insensitivity of cladding corrosion to annealing parameter in the range of approximately 1 to $4\times10^{17}$ hr (with Q/R=40,000° K.) is consistent with the results reported by Garzarolli. et al.

Corrosion Modeling

Representative subsets of fuel rods measured for oxide thicknesses from two relatively high coolant inlet temperature reactors (denoted as Reactor A and Reactor B) were used to perform data comparisons with an analytical corrosion model. The purpose was to analytically describe the differences in corrosion due to cladding tin content. Table 3 delineates the characteristics of the subsets addressed. Eight of the 10 rods in Subset A were measured for oxide after 2 cycles of irradiation as well as after 3 cycles of irradiation. Subset AA is composed of those 8 rods.

Reactor A has a nominal coolant inlet temperature of about 569° K. and operated with reactor cycle lengths of from about a year to 18 months. Reactor B's coolant inlet temperature was slightly lower, at about 563° K. Reactor B also operated with reactor cycles of slightly larger than 18 months. Reactor A and B both had an average subchannel coolant mass velocity of about 3730 $Kg/m^2$ sec. Since prediction of oxide thickness at high burnup was of primary interest, high burnup rods from both Reactor A and B were selected. It should be noted, however, that the cladding for high burnup rods in Reactor A was fabricated about 5 years earlier than that for the high burnup fuel rods irradiated in Reactor B. Condensed power histories for the data comparison rods are provided in Table 4.

The ESCORE PWR corrosion model was incorporated in a version of the ABB-CENF FATES fuel performance code. The ESCORE PWR corrosion model describes corrosion as a two stage process. An initial period of nonlinear time dependence (pre-transition) is followed by a period of linear time dependence (post-transition) The thickness at transition is dependent on temperature at the metal oxide interface and generally lies in the range of 2 to 3 microns for the oxide thicknesses of interest. The corrosion code accounts for the detailed fuel rod power history and thermal hydraulic environment.

A best-fit was first independently obtained for each subset of rods with high-tin cladding. The best-fit for each subset was derived by adjusting the pre-exponential coefficient (C) for the post-transition oxidation rate expression of the form:

$$\frac{ds}{dt} = C\exp(-Q/RT).$$

The coefficients that yielded the best fit for the oxide thickness values associated with representative fuel rods irradiated to the indicated burnup interval of the subsets analyzed are listed in Table 3. Addressing first the subsets of highest burnup high-tin clad fuel rods (A and E) different coefficients were needed to obtain the best fits. It is worth noting that the difference in the metal-oxide interface temperature that may be present between the Subsets A and E is accounted for by the exponential term in the oxidation rate equation. Therefore, Subsets A and E are expected to be predicted by essentially the same preexponential term if there was no difference in the material characteristics between these two groups of fuel cladding. The observed difference suggests some other difference in material beyond the nominal tin content reported. It is believed that at least part of this difference is related to the time period of cladding tube fabrication for subsets A and E. The cladding for the rods in Subsets A (and AA) and O were fabricated in 1981–82, well before fabrication history was recognized as an important variable affecting corrosion resistance. On the other hand, cladding for the rods in subsets C, D, E and F were fabricated in late 1985 to early 1986, when the importance of fabrication history was beginning to receive significant attention by the cladding fabricators. In addition, in the earlier period, the ingot chemical homogeneity probably was not at the level associated with later production. Because Subset A was fabricated much earlier than Subset E, the cladding for Subset A is believed to offer less corrosion resistance than Subset E. Because it is corroding more rapidly, Subset A rods have reached an oxide thickness beyond which corrosion is even further accelerated. Subset E is corroding less rapidly than Subset A because of its improved fabrication, and has not reached or has not significantly exceeded that oxide thickness at which further corrosion acceleration occurs. The difference in the multipliers between Subsets AA and C is also attributed primarily to the fabrication time period differences between Subsets A and C. A comparison of the best-fit multipliers for Subset A and AA suggests that corrosion has accelerated during the third cycle of irradiation for these rods. The reason for the corrosion rate acceleration may be hydride precipitation at the metal-oxide interface. In such a case, a feasible approach for modeling the enhancement would be to include a second transition point that is a function of oxide thickness to cause significant hydride precipitation, followed by corrosion associated with a higher rate compared to that of the rate after the first transition. Another possibility is degradation of oxide thermal conductivity due to radiation damage and growth stresses that eventually lead to oxide spalling. The current corrosion model in ESCORE does not include modelling of such high-burnup phenomena to cause acceleration.

To describe the effect of cladding tin content, the subsets of rods with lower than high-tin content were compared only with subsets of rods with comparable irradiation histories from the same reactor. Subset B was compared with Subset A; Subset D with C, and Subset F with E. For each pair of high-tin and lower tin content cladding subset, the posttransition corrosion rate derived for the subset of high-tin cladding was reduced to best predict the lower tin content cladding subset. Subset A's posttransition corrosion rate was reduced to predict Subset B's data, etc. The posttransition corrosion rate was fit independently for each subset of rods with low-tin cladding.

To predict lower oxide thickness for the low-tin zircaloy, two adjustments were considered to the posttransition corrosion equation: lowering the pre-exponential factor (C) or an increase of the activation energy (Q). Lowering of the pre-exponential term is consistent with fewer anion vacancies introduced in the oxide layer in a low-tin cladding. Increasing the activation energy for lower tin content also can be justified on the basis of the high temperature(823°–1173° K.) oxidation data of Mallet & Albrecht. However, changing the activation energy may make the model predictions more sensitive to change in temperature. Since the predicted metal/oxide interface temperature of the fuel rods investigated in this work did not vary significantly, it was decided to incorporate the tin content effect in the preexponential term (C) of the posttransition corrosion rate equation.

The pre-exponential multiplier for low-tin cladding was found to vary within the range of 71 to 74% of the high-tin cladding. For intermediate-tin cladding, the multiplier was about 82% of that rate for the high-tin cladding. Table 3 contains the pre-exponential multipliers that gave the best fit for the highest burnup rod in each subset of rods. The values listed are normalized with respect to the pre-exponential multiplier of ESCORE 136].

Predicted oxide thicknesses for the selected high burnup rods for Reactor A and B are shown in FIGS. 2 and 3 along with the measured values. Generally, the agreement between measured oxide thickness and model predictions is good.

Conclusions

1. The in-PWR corrosion resistance of Zircaloy-4 at high burnups improves by 30 to 40% when the tin content is reduced to the lower limit of the ASH composition range. Additional benefit may be possible by optimizing the tin and nitrogen concentration levels in Zircaloy-4.

2. Based on the autoclave test results, tin level within the examined range does not appear to affect the hydrogen uptake in Zircaloy-4.

3. The corrosion resistance improvement with lower tin levels can be modeled with an ESCORE-type corrosion model by adjusting the pre-exponential term in the posttransition corrosion rate equation. Reduction of the pre-exponential term with decreasing tin content, needed to provide a good prediction of the data, is consistent with the mechanism of a lower $O^2$ ion vacancy concentration in the zirconia lattice with a lower tin level in Zircaloy-4.

4. Results of 633° K. long-term water autoclave tests correlate well with the in-PWR cladding corrosion resistance of the investigated cladding variants.

Thus, the invention of the new alloy described in this specification is expected to achieve good corrosion resistance, irradiated ductility, and reduced hydrogen absorption by its selected composition. The exposure of Zirconium alloys to a water reactor environment results in irradiation damage to the microstructure and hydride precipitation. Both of these factors reduce the ductility and corrosion resistance of the irradiated alloys. The higher levels of alloying elements generally improve the strength and creep resistance of Zirconium alloys with a concurrent degradation of the corrosion resistance. A new zirconium alloy, according to this invention, with optimum levels of tin, iron, chromium, niobium, nickel, silicon, carbon, and oxygen is proposed that should provide a good combination of mechanical properties and corrosion resistance after irradiation.

REFERENCES:

1. D. E. Thomas, in *The Metallurgy of Zirconium,* Edited by B. Lustman and F. Kerze, Jr., McGraw-Hill, New York, 1955, pp 608–640.

2. J. Chirigos and D. E. Thomas, "The Mechanism of Oxidation and Corrosion of Zirconium", Proc. AEC Metallurgy Conf., March 1952, p 337, WAPD-53.

3. ASM Handbook, Volume 3, *Alloy Phase Diagrams,* ASM International, Materials Park, Ohio December 1992, p 2–300.

4. A. M. Garde, U.S. Pat. No. 4,879,093, "Ductile Irradiated Zirconium Alloy", issue date Nov. 7, 1989.

5. A. M. Garde, U.S. Pat. No. 5,080,861, "Corrosion Resistant Zirconium Alloy", issue date Jan. 14, 1992.

TABLE 1

Zircaloy-4 Cladding Material Characteristics Used In Reactor A Demonstration Fuel Assemblies and Long-term Autoclave Testing

| Variant | Sn % | Fe % | Cr % | N, ppm | ΣAi, $10^{-17}$ hours |
|---|---|---|---|---|---|
| 1 (a) | 1.54 | 0.21 | 0.10 | 24 | 1.2 |
| 2 | 1.54 | 0.21 | 0.10 | 17 | 4.1 |
| 3 (b) | 1.33 | 0.21 | 0.11 | 27 | 1.2 |
| 4 | 1.33 | .21 | 0.11 | 27 | 4.1 |
| 5 | 1.50 | 0.21 | 0.10 | 14 | 1.2 |
| EPRI Standard (c) | 1.55 | 0.22 | 0.11 | 24 | 1.0 |

(a) Representative of Reactor A high-tin production cladding
(b) Representative of low-tin cladding used in Reactors A and B
(c) Autoclave tested only - not irradiated in Reactor A

TABLE 2

| Cladding Variant | Duration, Days | Post Autoclave Corrosion Test (633° K. Water) Hydrogen Concentration Measurements: Weight Gain After Corrosion Test, mg/dm² | Measured Hydrogen (a), ppm: Laboratory A | Laboratory B | Hydrogen Pickup Fraction, % (Based on Average H Concentration) |
|---|---|---|---|---|---|
| 1 | 808 | 335 | 609, 606, 602 | 516, 508 | 26.2 |
| 2 | 808 | 325 | 616, 581, 612 | 508, 539 | 26.8 |
| 3 | 1331 | 457 | 913, 822, 917 | 757, 757 | 26.5 |
| 4 | 1331 | 522 | 1006, 971, 999 | 846, 816, 842 | 26.3 |
| 5 | 524 | 217 | 469, 465 | 338, 324 | 29.9 |
| EPRI Std. | 661 | 371 | 775, 782 | 589, 573 | 25.8 |

(a) Oxide layer on specimen was not removed

TABLE 3

Subsets of Data Comparison Rods

| Subset | Reactor | Reactor Cycles Irradiated | # of Rods for Data Comparison | Range of Rod Average Burnup, GWd/MTU | Cladding[a] Tin Content | Fabrication Corresponds to Variant Number from Table 1 | Pre-Exponential Multiplier,[b] Normalized to ESCORE |
|---|---|---|---|---|---|---|---|
| A | A | 3 | 10 | 37.3–48.1 | High | EPB[c] | 1.31 |
| AA | A | 2 | 8 | 22.5–31.3 | High | EPB | 1.03 |
| B | A | 3 | 5 | 45.4–48.1 | Intermediate | EPB | 1.08 |
| C | A | 2 | 10 | 32.6–36.1 | High | Variant 1 | 0.84 |
| D | A | 2 | 10 | 32.0–36.0 | Low | Variant 3 | 0.60 |
| E | B | 2 | 19 | 44.4–48.4 | High | Variant 1 | 0.92 |
| F | B | 2 | 21 | 44.0–48.6 | Low | Variant 3 | 0.68 |

[a]High tin content range, 1.51 to 1.70 wt %
Intermediate tin content range, 1.45 to 1.50 wt %
Low tin content range, 1.20 to 1.44 wt %
[b]The indicated pre-exponential multipliers provided best-fit predictions of the data shown in FIGS. 2 and 3.
[c]EPB = Early Production Batches Fabricated in 1981–82.

TABLE 4

Power History for Data Comparison Rods

| Reactor | Subset | Reactor Cycle of Irradiation | Cycle Length, EFPD's[a] | Range of Average LHGR for Cycle for Data Comparion Rods W/cm |
|---|---|---|---|---|
| A | A, B | 1 | 445 | 83–186 |
| | | 2 | 285 | 186–220 |
| | | 3 | 500 | 150–169 |
| A | AA | 1 | 445 | 83–182 |
| | | 2 | 285 | 186–220 |
| A | C, D | 1 | 285 | 135–217 |
| | | 2 | 500 | 216–230 |
| B | E, F | 1 | 535 | 212–245 |
| | | 2 | 515 | 181–200 |

[a]EFPD = Effective Full Power Days

TABLE 5

Preferred Embodiment Modified Zirconium Alloy

| | Range | Typical |
|---|---|---|
| Tin, Sn, Wt. % | >0 to 1.50% | 0.6% |
| Iron, Fe, Wt. % | ≧0 to 0.24% | 0.12% |
| Chromium, Cr, Wt. % | ≧0 to 0.15% | 0.10% |
| Nitrogen, N, | up to 2300 ppm | |
| Silicon, Si | ≧ or about 100 ppm | 70 ppm |
| Oxygen, O | ≧ up to 1600 ppm | 1200 ppm |
| Niobium, Nb, Wt. % | > 0 to 0.5% | 0.45% |
| Zirconium | Balance | Balance |

I claim:

1. A zirconium alloy for use in nuclear core structure elements and fuel cladding, which comprises an alloy composition as follows:

tin, in a range of greater than 0 to about 1.50 wt. %;

iron, in a range of greater than or equal to 0 to about 0.24 wt. %;

chromium, in a range of greater than or equal to 0 to 0.15 wt. %;

niobium, in a range of greater than 0 to about 0.5 wt. %;

nitrogen, in a range of greater than or equal to 0 to about 2300 ppm;

silicon, in a range of 0 to 100 ppm;

oxygen, in a range up to 1600 ppm; and the balance being of zirconium.

2. The alloy composition as set forth in claim 1, wherein said tin is typically about 0.6 wt. %.

3. The alloy composition as set forth in claim 1, wherein said iron is typically about 0.12 wt. %.

4. The alloy as set forth in claim 1 wherein said chromium is about 0.10 wt. %.

5. The alloy as set forth in claim 1 wherein said niobium is about 0.45 wt. %.

6. The alloy as set forth in claim 1, wherein said nitrogen is present in a range of greater than or equal to 27 ppm to about 2300 ppm.

7. The alloy as set forth in claim 1, wherein said tin level is established to meet predetermined mechanical characteristics and said nitrogen level is determined by said tin level.

8. A zirconium alloy for use in light water nuclear core structure elements and fuel cladding, which comprises a composition which includes tin in a range of greater than 0 to about 1.50 wt. % to improve corrosion resistance of said alloy in combination with nitrogen in a range greater than 0 to 2300 ppm wt. % and niobium present in a range of a measurable amount up to 0.5 wt. %, said nitrogen and said niobium acting in combination with said tin to improve the mechanical properties of said alloy, said niobium negating at least in part an increase of hydrogen uptake in said alloy as a result of said iron level.

9. The alloy as set forth in claim 8, further including chromium in an amount greater than or equal to 0 to 0.15 wt. %; and silicon in a range of 0 to 100 ppm to reduce the hydrogen absorption by the alloy and to reduce variation of corrosion resistance with variation in the processing history of the alloy, and oxygen in a range of up to 1600 ppm as a solid solution strengthening alloying element; and the remainder zirconium.

10. The alloy composition as set forth in claim 8, wherein said tin is typically about 0.6 wt. %.

11. The alloy as set forth in claim 8 wherein said niobium is about 0.45 wt. %.

12. The alloy as set forth in claim 8, wherein said tin level is established to meet predetermined mechanical characteristics and said nitrogen level is determined by said tin level.

13. The alloy as set forth in claim 8, wherein said nitrogen is present in a range of greater than or equal to 27 ppm to about 2300 ppm.

14. The alloy composition as set forth in claim 10, wherein said iron is typically about 0.12 wt. %.

15. The alloy as set forth in claim 10 wherein said chromium is about 0.10 wt. %.

* * * * *